United States Patent [19]

Kasper

[11] 4,222,456

[45] Sep. 16, 1980

[54] SOUND-SUPPRESSING AND BACK PRESSURE-REDUCING APPARATUS AND METHOD

[76] Inventor: Witold A. Kasper, 1853 132nd SE., Bellevue, Wash. 98005

[21] Appl. No.: 790,480

[22] Filed: Apr. 25, 1977

[51] Int. Cl.[3] ..... F01N 1/12

[52] U.S. Cl. ..... 181/296; 181/251; 181/268; 181/280; 181/238

[58] Field of Search ..... 181/296, 251, 259, 220, 181/238, 280, 279, 268, 250, 239; 239/11, 590.5

[56] References Cited

U.S. PATENT DOCUMENTS

| | | | |
|---|---|---|---|
| 2,359,365 | 10/1944 | Katcher | 181/280 |
| 2,624,418 | 1/1953 | Bourne | 181/251 |
| 2,944,623 | 7/1960 | Bodine | 181/213 |
| 3,648,802 | 3/1972 | Pierce | 181/280 X |
| 3,888,331 | 6/1975 | Wang | 181/280 X |
| 4,050,539 | 9/1972 | Kashiwara | 181/280 |
| 4,050,632 | 9/1977 | Wyse | 239/590.5 X |

FOREIGN PATENT DOCUMENTS

| | | | |
|---|---|---|---|
| 602279 | 2/1960 | Italy | 181/251 |

*Primary Examiner*—Francis S. Husar
*Assistant Examiner*—K. J. Ramsey
*Attorney, Agent, or Firm*—Thomas W. Secrest

[57] ABSTRACT

This invention is directed to an apparatus and method for treating a flowing gas so as to decrease the back pressure of the flowing gas and the noise of the flowing gas.

3 Claims, 3 Drawing Figures

SOUND-SUPPRESSING AND BACK PRESSURE-REDUCING APPARATUS AND METHOD

THE BACKGROUND OF THE INVENTION

A flowing gas, such as an exhaust from a motor and an engine, creates a noise and can be considered to be noise pollution and also has some back pressure with respect to the pressure of the gas in the engine. For example, an internal combustion engine, such as a gasoline engine or a diesel engine or a kerosene engine, has an exhuast gas. The exhaust gas, directly, from the internal combustion engine produces considerable noise. In order to decrease this noise, there is employed a muffler. Generally, a muffler comprises a chamber having an inlet and an outlet. The chamber is much larger in cross-sectional area than the cross-sectional area of the inlet or the cross-sectional area of the outlet. Further, the volume of the chamber is much greater than the volume of the inlet tube and the volume of the outlet tube. Sometimes, a chamber may have baffles to reduce the noise. The speed of the exhaust gas upon entering the chamber from the inlet tube decreases in velocity so as to decrease the amount of noise. Further, the muffler and the chamber are made of metal so that heat energy is transmitted through the metal of the muffler or the metal surrounding the chamber so as to have a cooling effect and also with the cooling effect decrease the volume of the gas being exhausted from the chamber in comparison to the volume of the gas entering the chamber. One of the advantages of the muffler is to decrease the noise from the internal combustion engine and thereby decrease noise pollution. However, in the type of muffler just described, there is considerable back pressure with respect to the exhaust gas from the internal combustion engine. This back pressure decreases the efficiency of the internal combustion engine so that if the exhaust gas from the internal combustion engine were not under back pressure, the efficiency of the internal combustion engine would be greater than with the use of the muffler described.

In preparing for this patent application a patent search was made. The results of this patent search reveal the following related sound-suppressing devices of the following U.S. Pat. Nos.

981,770
1,383,150
1,489,422
2,788,078
2,353,914
2,944,623
2,957,537
3,374,857

THE GENERAL DESCRIPTION OF THE INVENTION

With this invention, I have provided an apparatus and method for treating a stream of flowing gas. For example, the stream of flowing gas can be divided into a first stream of gas and into a second stream of gas. The first stream of gas is accelerated so as to flow faster than said flowing gas and the second stream of gas is decelerated so as to flow slower than said flowing gas. This is accomplished by expanding the second stream of gas so as to allow it to flow slower and also by compressing the first stream of gas to increase its speed of flow. There is imparted to the second stream of gas a rotating motion and there is imparted to the first stream of gas an axial flow. The first stream of gas is discharged, centrally, into the second stream of gas. This way the outflowing gas is leaving the exhaust pipe in the form of a vortex. This vortex motion has the inherent property to eliminate the noise caused by friction of the exhaust gases when they encounter the still outside air and another effect is the drop of pressure in the axial flow part of the vortex which eliminates the back pressure in the whole exhaust line system. The result is that there is less noise or a muffling of the noise by this discharge of the first stream of gas into the second stream of gas and another result is that there is less back pressure because of the vortex motion and vortex effect achieved by discharging the first stream of gas, having an axial flow, into the second stream of gas having a rotating flow. In effect, there is a decrease in noise and there is a decrease in back pressure with a resulting increase in the efficiency of the internal combustion engine. In the case of a by-pass jet engine, the central, high speed axial flow already existing, only the by-pass air has to be induced into rotary motion by means of slanted vanes to obtain a vortex flow with all the beneficial behavior like noiselessness and lower back pressure.

THE OBJECTS AND ADVANTAGES OF THE INVENTION

One of the important objects of this invention is to provide a method to lessen the noise of flowing gas, such as exhaust gas; another important object of this invention is to provide a method for reducing the back pressure of flowing gas, such as exhaust gas; an additional object of this invention is to provide an inexpensive apparatus to decrease the noise of flowing gas and to decrease the back pressure of flowing gas; another additional object is to provide such an additional apparatus which is inexpensive and easy to install with respect to the exhaust system of an internal combustion engine; an additional and important object is to provide such an apparatus having a long life and in which apparatus moisture cannot condense and thereby rust the metal of the apparatus as the moisture is discharged with the gas flowing from the apparatus.

These and other important objects and advantages of the invention will be brought forth upon reference to the detailed description of the invention, the appended claims, and the accompanying drawings.

THE DRAWINGS

THE SPECIFIC DESCRIPTION OF THE INVENTION

Figure 1:
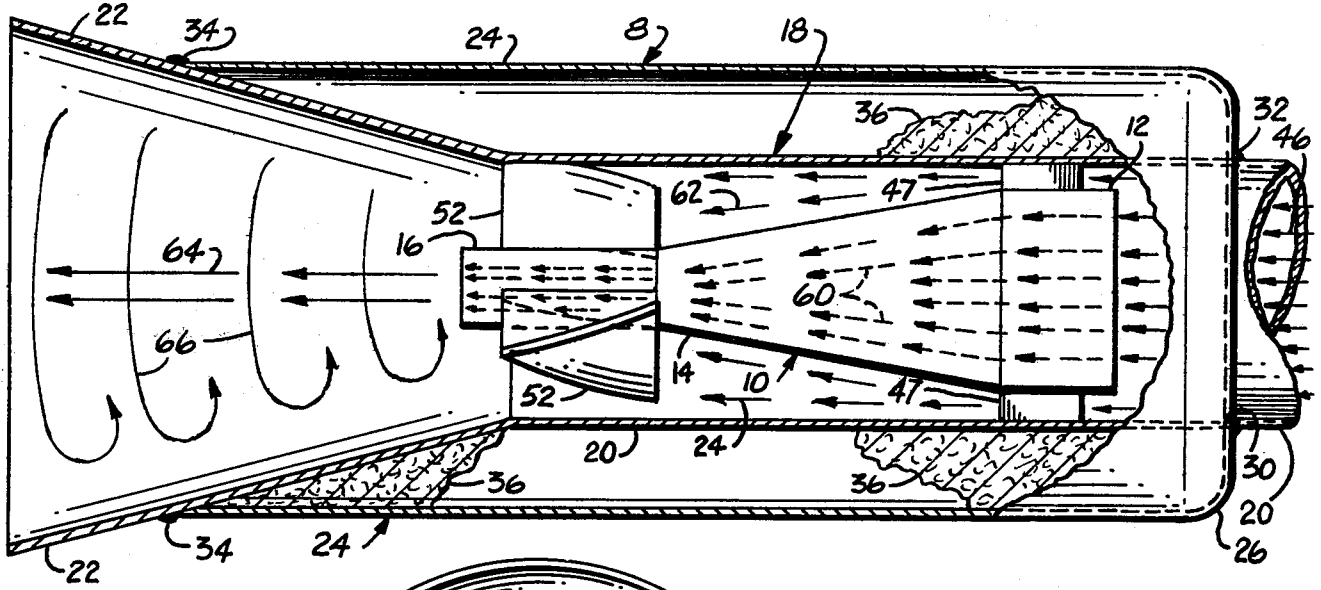
FIG. 1 is a longitudinal cross-sectional view illustrating the components of this invention and in particular a converging tube inside an expanding tube.
Figure 2:
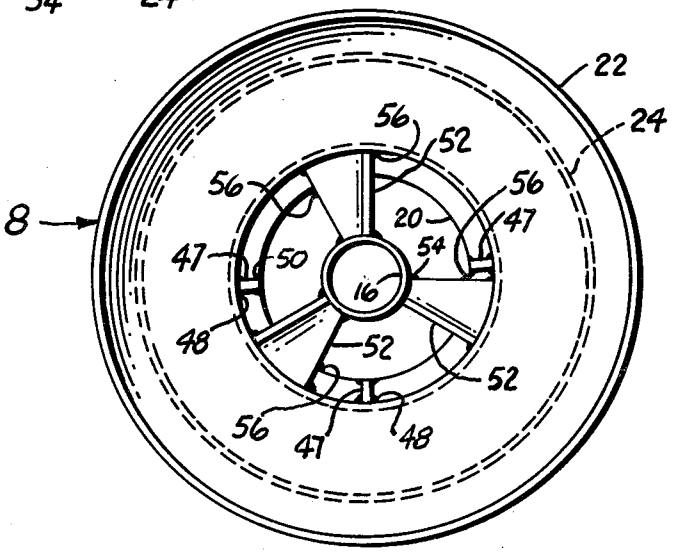
FIG. 2 is an end view looking into the exhaust of the apparatus and illustrates the expanding tube, the converging tube, and vanes for imparting a rotary motion to the gas in the expanding tube; and, FIG. 3 is a view illustrating the details of construction of the inner tube, vanes, outer tube, and the housing, and sound deadening material in the apparatus.

With reference to FIGS. 1 and 2, it is seen that the apparatus comprises a series of tubes. There is a first tube or an inner tube 10 having a large end 12, a converging middle section 14, and a small end or a discharge end 16.

It is seen that there is a second tube or an outer tube 18 having a first part 20 and a second part which is an expanding tube or a frustum of a cone 22.

There surrounds the tubes 10 and 18 a housing 24 having a circular base 26 and cylindrical walls 28.

In the circular base 26, there is an opening 30. The first part 20 of the second tube 18 is positioned in this opening and projects outwardly of the housing 24. The second tube 18 and the circular base 26 are welded at 32. Also, the cylindrical walls 28 of the housing 24 and expanding tube 22 are welded at 34 to make an integral unit of the second tube 18 and the housing 24.

The housing 24 may be considered to be a cup or a container having the circular base 26 and the cylindrical walls 28 but with an opening 30 in the circular base 26.

There is positioned between the cylindrical walls 28 and the second tube 18, a sound-deadening and heat-conducting material 36. This sound-deadening and heat-conducting material 36 may be steel wool. It is possible to use other material than steel wool, such as copper wool or copper strands. It is desirable that the material 36 be both a conductor of heat to conduct heat from the second tube 18 to the housing 24 so as to dissipate the heat and also that the material 36 be a sound-deadening material.

Figure 3:
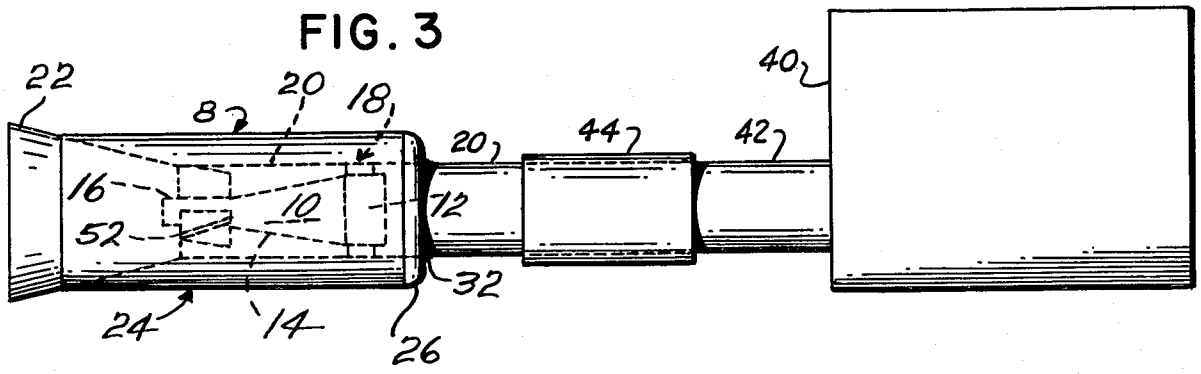

The apparatus 8 is connected to the exhaust from an engine or a motor 40, see FIG. 3. The engine or motor 40 has exhaust gases from the combustion of fuel, such as hydrocarbons or coal, and these exhaust gases are discharged through a tube 42. A sleeve 44 connects the tube 42 and the first part 20 of the second tube or outer tube 18. The exhaust gases from the engine or motor 40, flowing through the tube 42 and into the first part 20 are identified as flowing gas 46.

In FIGS. 1 and 2, it is seen that the first tube 10 and the second tube 18 are concentric with respect to each other with the first tube being inside the second tube. The large end 12 of the first tube or large part of the first tube is now positioned in the circular base 26 of the housing 24. The converging middle section 14 of the inner tube is positioned inside the first part 20 of the outer tube. Also, the main part of the small end or discharge end 16 of the first tube is positioned inside the outer tube although the discharge end of the small tube 16 is positioned inside the expanding tube 22. The expanding tube 22 may be considered to be in the configuration of a frustum of a cone.

There is positioned between the inner surface of the first part 20 of the second tube 18 and the outer surface of the large end 12 of the first tube 10, a plurality of positioners 46. These positioners can be welded at 48 to the inner surface of tube 18 and at 50 to the outer surface of the large end 12 of the first tube 10. In FIGS. 1 and 2, it is seen that surrounding the small end 16 of the inner tube 10 are vanes 52. These vanes 52 are curved. The vanes near the junction of the first part 20 and the expanding tube 22 are welded at 54 to the outer surface of the discharge end 16 and are welded at 56 to the inner surface of the first part 20 of the second tube 18.

The flowing gas 46, upon flowing into the apparatus 8 through the first part 20, is divided by the large end 12 of the inner tube 10 and the first part 20 of the outer tube 18, into a first stream of gas 60 and a second stream of gas 62. In FIG. 1, it is seen that the first stream of gas 60 is in the converging inner tube 10 and that its speed is accelerated. The first stream of gas is discharged at a higher speed than the flowing gas 16, into the central portion or inner portion of the expanding tube 22, and is identified by reference numeral 64.

The second stream of gas 62 expands and upon expansion decelerates or slows in speed. The second stream of gas 62 flows past the vanes 52. Again, these vanes 52 are curved and impart to the second stream of gas 62, a rotating motion. In FIG. 1, it is seen that between the positioners 46 and the vanes 52, that the cross-sectional area between the first part 20 and the converging middle section 14 increases so that the speed of the flowing gas 62 decreases. Then, the flowing gas, upon flowing past the vanes 52, is given a rotating motion, as illustrated by the curved lines 66. The second stream of gas 62, upon entering the expanding tube 22, and with a rotating motion, decelerates or slows in speed.

Now, with the rotating gas 66 flowing at a relatively slow speed and also decelerating, and with the inner stream of gas 64 flowing in a rectilinear path and at a high speed, there is produced a vortex. With the introduction of the vortex, there is a decrease in pressure inside the apparatus 8. This decrease in pressure, with respect to the pressure of the flowing gas 46 from the engine or motor 40 and flowing into the first part 20, is the equivalent of a vacuum so as to have less pressure in the apparatus 8 than the pressure of the gas from the engine or motor 40. The result is less back pressure on the engine or motor 40 and therefore an increase in fuel efficiency. A further benefit is that with the vortex action, there is a decrease in noise and the apparatus 8 functions as a muffler for the noise of the gas flowing from the engine or motor 40. Another benefit is that with a reduction in pressure on the gases 64 and 66 from the apparatus 8 and the equivalent of a vacuum with respect to the flowing gas 46, there is allowed an opportunity for the combustible fuel, such as hydrocarbons and even coal in the engine 40 a more complete combustion of this fuel and therefore less air pollution.

I consider that with this apparatus 8 that it may be possible to increase the fuel efficiency or the efficiency of the engine or motor 40 by approximately 10% to 15%. For example, with an automobile engine, such as an internal combustion engine for burning gasoline or diesel fuel, both hydrocarbons, that there can be an increase in the mileage of the automobile from 10% to 15%. For example, if an automobile having an internal combustion engine averages 20 miles per gallon of fuel, then it is possible to increase the mileage to about 22 or 23 miles per gallon. Further, I consider the apparatus 8 will function just as well with an internal combustion engine burning a gas, such as liquified petroleum gas or propane or butane and the like.

With respect to the apparatus 8 being used as a muffler, I can state that noise is created when a first moving air mass is encountering still air such as the exhaust gas from an engine encountering the gas in the surrounding atmosphere. The friction between these two air masses slows the fast moving exhaust gas. The kinetic energy in the slowing process of the exhaust gas is transformed into sound waves obeying the law of energy conservation whereby the total amount of energy is a constant. The noise produced by the slowing of the fast-moving gas into the surrounding atmosphere is directly proportional to the square of the speed difference between the two air masses. In order to prevent this noise, the slowing of the speed of the fast moving air gas or air mass has to be accomplished gradually from maximum speed to zero speed or the speed of the gas in the surrounding atmosphere.

I consider that the use of a vortex motion can be beneficial in the slowing of the exhaust gas. In a vortex motion, the tangential speed component of the outer ring of the vortex, see gas flow 66 in FIG. 1, decreases with the increasing radius. Again, see the gas flow 66 in the expanding tube 22. The speed of a gas flow is a minimum at the outer radius and a maximum at the inner radius enveloping the core where the flow changes to axial flow. This gradual decrease of the tangential speed component toward the outer radius, where it is encountering and meeting the slower moving or still air, is the reason vortices are silent in spite of very high speeds near the center of the core vortex. For example, a tornado, whirlpool, aircraft tip vortices and the like are silent at the center of the vortex. Another property of the vortex flow is an adiabatic pressure drop from the ambient pressure in the outer part of the vortex to the much lower pressure in the core of the vortex with the inherent temperature drop. An example is the very low pressure in the eye of a tornado. In FIG. 1 and in the apparatus 8, it is seen that the rotating flowing gas 66 is flowing at a slower speed than the high-speed gas 64 which is flowing in a rectilinear direction. These two properties of the vortex motion are used in the design of the apparatus 8 and the muffler 8.

In the case of the internal combustion engine, such as a reciprocating engine, and also in the case of a by-pass jet engine, the linear gas flow is transformed into a vortex flow in the last part of the exhaust pipe so that when the gases emerge into free air, the speed differences are very small in the outer diameter of the vortex as compared with the speed of the free air and yet is still very high in the inner core of the vortex where the gas is flowing in a linear motion. Again, with reference to FIG. 1, it is seen that the rotating gas stream 66 flows at a lower velocity than the inner gas stream 64 which flows in a linear pattern. The rotating gas stream 66 contacts the surrounding air of the atmosphere, and obeys the constant momentum law at a very low speed and that the difference in speed between the rotating gas 66 and the surrounding atmosphere is not large and therefore there is not produced the noise between the two contacting gases. The vortex motion produced by the apparatus 8 with respect to the rotating gas 66 and the linear gas 64 permits a complete evacuation of the exhaust gas from the engine or motor 40 without generating noise. In order to achieve the vortex flow in the apparatus 8, the linear flow in the center is accelerated by means of the convergent first tube 10 while the outer flow is given a rotating motion by means of the slanted vanes 52 in the second tube 18. The flow emerging past this arrangement is a vortex of the "bathtub type" whereby the water flowing from the bottom of the bathtub flows in a vortex motion. Consequently, the apparatus 8 in producing the vortex motion, prevents the formation of noise, decreases the back pressure on the flowing gas 46 from the motor or engine 40, and the pressure in the exhaust pipes ahead of the "vortex silencer" is decreased below the atmospheric pressure, acting the same way as a supercharger which also increases the pressure difference between the intake gas and the exhaust gas. These two last actions increase the power output of the engine or motor 40 and permit a better scavenging of the exhaust gases from the engine or motor 40 so as to decrease air pollution. In the case of a jet by-pass engine, the straight axial flow from the engine is made by the jet stream and only the by-pass air has to be redirected into the rotational flow by means of slanted vanes in order to form a vortex.

In the constant momentum law, it is known that the radius times the square of the velocity ($rv^2$=constant) is a constant. With an increase in the radius in the expanding tube 22, for the rotating flowing gas 66, there is a corresponding decrease in the velocity.

Basically, a vortex occurs as four-dimensional system with the fourth dimension being time. As a closed system, the vortex will decay unless replenished from an outside source. This source may be applied tangentially on the periphery of the whirling mass or axially through the center as exemplified in the draining of a bathtub. A tornado is another axially sustained example in which the rising warm air column yields its heat energy in the form of motion as it rises, expands, and then cools. In a hurricane, this activity is further augmented by condensation water in the warm, moist air as it cools, thereby releasing the latent heat of condensation to the activity and building a tremendous energy machine. In the subject internal combustion engine exhaust system, the vortex is augmented, actually, through the center tube or converging inner tube 10 like the core of a tornado. The centrifugal rotation of the outer envelope due to the expanding tube 22, is initiated by the inclined guide vanes 52 at the beginning of the exit column or expanding tube 22. As the inner and outer gas columns merge, centrifugal rotation of the whole mass takes place with attendant temperature and pressure drops of the hot gases which provide the energy to sustain the activity. A result is a decrease in sound level and also a decrease in pressure so as to have better scavenging action of the motor or engine 40 and less back pressure on the motor or engine 40.

I consider my invention to be new, useful and unobvious as I have never seen an apparatus similar to apparatus of this invention or apparatus 8 of this invention and never seen a muffler like apparatus 8. Further, I consider this invention to be useful as it decreases the noise of exhaust gas and also increases the efficiency of an internal combustion engine and decreases pollution produced by an internal combustion engine.

From the foregoing and having presented my invention, what I claim is:

1. A method for controlling the flow of a flowing gas, said method comprising:

a. dividing said flowing gas into a first stream of gas and into a second stream of gas;
b. accelerating the first stream of gas to flow faster than said flowing gas;
c. decelerating the second stream of gas to flow slower than said flowing gas; and,
d. said first stream of gas flowing inside said second stream of gas.

2. A method for controlling the flow of a flowing gas, said method comprising:

a. dividing said flowing gas into a first stream of gas and into a second stream of gas;
b. accelerating the first stream of gas to flow faster than said flowing gas;
c. decelerating the second stream of gas to flow slower than said flowing gas;
d. expanding said second stream of gas;
e. imparting a rotating motion to said second stream of gas;
f. said first stream of gas flowing inside said second stream of gas; and,
g. imparting an axial flow to said first stream of gas.

3. A method according to claim 2 and comprising:

a. the rotational flow of said second stream of gas and the axial flow of said first stream of gas inside said second stream of gas creating a vortex and a negative pressure with respect to said flowing gas.

* * * * *